United States Patent [19]

Stobb

[11] Patent Number: 4,880,350

[45] Date of Patent: Nov. 14, 1989

[54] METHOD AND APPARATUS FOR HANDLING STACKS OF SHEETS

[75] Inventor: Walter J. Stobb, Pittstown, N.J.

[73] Assignee: Stobb, Inc., Clinton, N.J.

[21] Appl. No.: 240,671

[22] Filed: Sep. 6, 1988

[51] Int. Cl.[4] ..... B65H 31/30

[52] U.S. Cl. ..... 414/790.2; 271/217; 414/790; 414/907; 414/924; 414/786

[58] Field of Search ..... 271/157, 217, 218, 220; 414/790.1, 790.2, 789.9, 790, 790.8, 923, 924, 926, 907, 786

[56] References Cited

U.S. PATENT DOCUMENTS

| | | | |
|---|---|---|---|
| 2,933,314 | 4/1960 | Stobb | 271/88 |
| 3,739,924 | 6/1973 | Stobb | 414/43 |
| 3,969,993 | 7/1976 | Stobb | 93/93 |
| 4,068,837 | 1/1978 | Lamos | 271/220 X |
| 4,247,093 | 1/1981 | Kistner | 414/114 X |
| 4,311,090 | 1/1982 | Dudziak et al. | 414/907 X |
| 4,383,788 | 5/1983 | Sylvander | 414/907 X |
| 4,477,218 | 10/1984 | Bean | 271/220 X |
| 4,541,763 | 9/1985 | Chandhoke et al. | 414/43 X |
| 4,554,867 | 11/1985 | Thumm | 100/3 |
| 4,588,070 | 5/1986 | Smith | 414/790.2 X |
| 4,618,054 | 10/1986 | Muller | 198/409 |

*Primary Examiner*—Frank E. Werner
*Assistant Examiner*—William M. Hienz
*Attorney, Agent, or Firm*—Arthur J. Hansmann

[57] ABSTRACT

Method and apparatus for handling stacks of sheets, including a carrier for lowering the sheets in a stacker and having a clamp which applies to the bundle and moves therewith throughout the lowering process. The clamp is mounted on the carrier for movement into and out of clamping position, and in the clamping position it permits the bundles to be lowered without bending or distorting the sheets which are otherwise dragging on a stationary support.

9 Claims, 1 Drawing Sheet

METHOD AND APPARATUS FOR HANDLING STACKS OF SHEETS

This invention relates to a method and apparatus for sheet stacking, such as sheets of paper which are coming from a printing press and are collected in a sheet stacker.

BACKGROUND OF THE INVENTION

The prior art is well aware of the construction and utilization of sheet stackers which automatically form a stream of sheets into a stack. U.S. Pat. Nos. 2,933,314 and 3,969,993 and 4,554,867 show the method and apparatus of forming a stack of sheets from a continuously moving stream of the sheets which enter the stack. The stack is then lowered away from the stream and is appropriately handled for compression and typing, if desired. With respect to compressing a stack, U.S. Pat. No. 3,739,924 shows that method and apparatus where the stack is compressed after it is in its lowered position on equipment for compressing and binding the stack.

In the lowering of the stack from its initial position of formation adjacent the stream and to its lowered position for lateral movement away from the stacker, such as shown in the aforementioned patents, the stack is not clamped or otherwise secured while it is moving downwardly, and there thus is a tendency for the sheets on the top of the stack to become upset as they slide along their support. This precludes a neat and undamaged arrangement of the sheets at least on the upper end of the stack.

The present invention overcomes the aforementioned problem of neatness and sheet damage, as well as the lack of compactness of the total stack, and it does so in an automated method and apparatus which permits the desired complete control of the stack in moving the stack away from its position adjacent the stream of sheets.

In accomplishing the aforementioned, there is both method and apparatus involved herein whereby the stack is clamped prior to its movement away from the stream, and it thus can be moved in a clamped relationship from its position of formation and on to its position of destination. As indicated, this method and apparatus pertains without the interruption, or even the slowing down, of the collection of the sheets into the stack and also the movement of the stack from its initial collected position and to the desired destination thereof.

DETAILED DESCRIPTION OF THE METHOD AND APPARATUS

Figure 1:
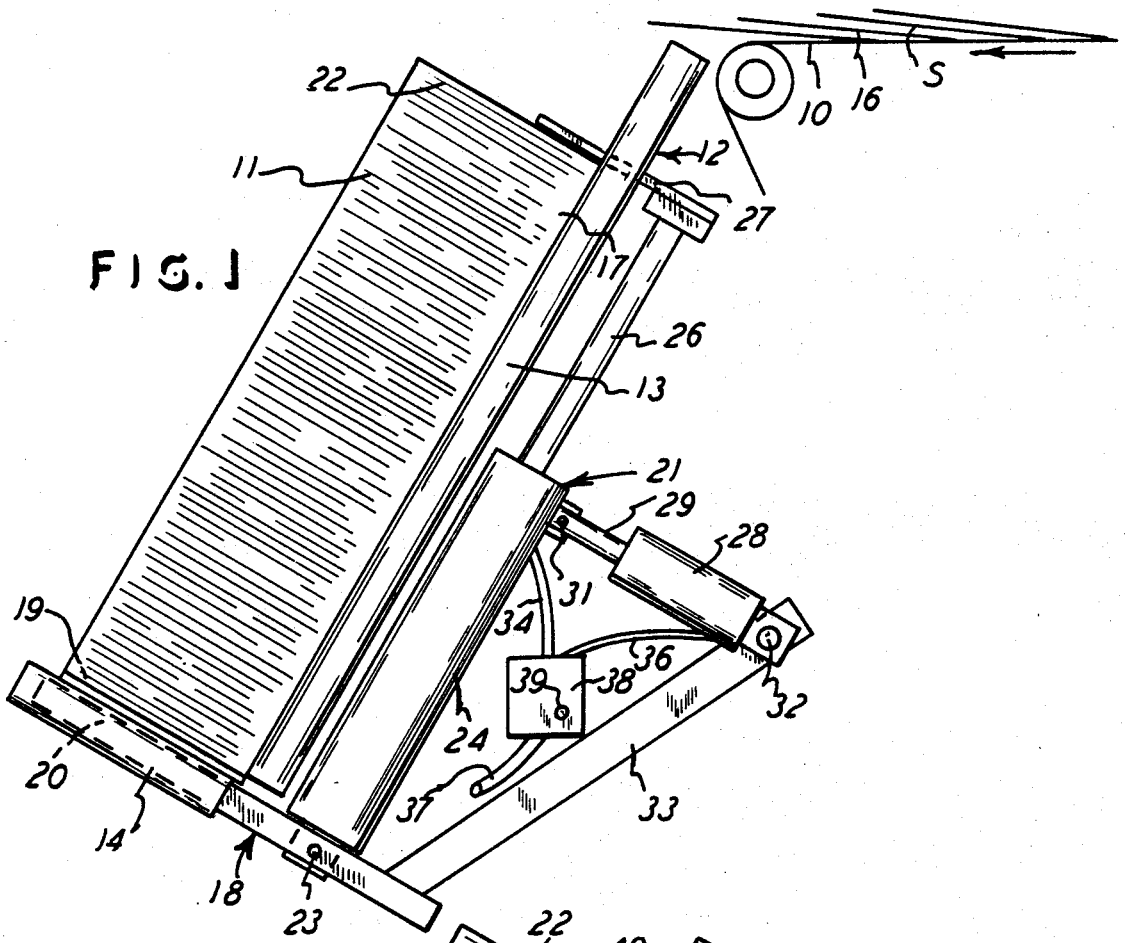
FIG. 1 is a side elevational view of one embodiment of this invention applied to a stacker shown in a portion thereof.

The following description of the apparatus will inherently include description of the method or process of sheet stacking and bundle or stack handling. Also, as previously mentioned, the stacking relates to the stacker, such as that shown in U.S. Pat. Nos. 3,969,993 and 4,554,867, the disclosures of which are incorporated herein by reference for the showing of stacking on an inclined stacker having apparatus for lowering the inclined stack downwardly from the upper and thus first position to the lowered and thus second position, as shown in FIG. 1 of said patents.

Thus, it will be understood by one skilled in the art that a shingled or imbricated stream of sheets moves into the stacker area, such as indicated by the stream designated S which is supported on the incoming conveyor 10 and moving in the direction of the arrow. Just as in the referenced patents, the stream is formed into a stack, and is ultimately positioned such as with the stack 11 shown in FIGS. 1 and 2.

That is, there is a stacker, generally designated 12, which includes the upstanding or back support or roller 13 and the lower support or roller 14, again just as in the referenced patents. The stack 11 formed from the stream S is supported by the rollers 13 and 14 which are portions of the stacker 12, and which are of conventional arrangement.

The concern and problem with the prior art is presented with regard to lowering the stack 11 from the elevation of the stream S, which is the elevation where the stack is initially formed, and is thus the upper and first position. That is, when the stack 11 is lowered in the stacker 12, the respective sheets 16 in the stack 11 have their resting edges 17 sliding downwardly on the roller 13, and it will be understood that there is a row of rollers 13, as in the referenced patents which show the upper and lowered positions. That arrangement and action causes the sheet edges 17 to bend or drag and to thus become misaligned with respect to the remaining plane of each sheet 16 in the stack 11. That misalignment or distortion of the sheet edge 17 must then be dealt with, such as by manually repositioning the distorted or curved edge 17 to place it into aligned or planar position with the remainder of the sheets 16 in the stack 11, in the prior art.

In the lowering of the stack 11 from the elevation of the stream S, it is common practice to use a carrier, which is the upper position and thus first position, such as the carrier designated 18 herein. The carrier provides a support for the bundle lower end 19, since the carrier extends across the lower face of the bundle 11 which rests upon the carrier 18. Also, it will be readily understood by one skilled in the art that the carrier 18 elevates up-and-down, along the longitudinal axis of the roller 13, for thus lowering the bundle 11 while the bundle is being formed off the stream S, and for final lowering of the bundle 11 onto the lower roller 14, in the position shown in FIGS. 1 and 2 which is the lowered and thus second position. Of course suitable mechanism is utilized in the carrier 18 for the lowering of the bundle 11 onto the roller 14, such as that shown in the referenced patents.

To overcome the problem of distorting the sheets edges 17 in the lowering function, a clamp 21 is applied to the bundle 11 at the time that the bundle is fully formed and has its upper end 22 at the elevation of the stream S. At that time, the bundle is ready to be lowered into the position shown in FIGS. 1 and 2, and thus the sliding action along the row of rollers 13, or any like underneath support is encountered and presents the problem mentioned.

The clamp 21 is mounted on the carrier 18 to move up-and-down with the elevating movement of the carrier 18. Therefore, when the bundle 11 is fully formed and at the upper or elevated position and ready to be lowered, the clamp 21 is applied to the bundle, and then the carrier 18 along with the clamp 21 are both moved downwardly to position the bundle 11 onto the lower support, such as the row of rollers 14. In that action, the sheet edges 17 sliding along the row of rollers 13 are not distorted since the sheets 16 in the bundle 11 are held securely by the clamp 21.

Accordingly, the clamp 21 is shown to be pivotally mounted on the carrier 18 by means of pivot pin 23, and the clamp includes a cylinder assembly consisting of a cylinder 24 and a piston rod 26 which is extendable and retractable relative to this cylinder 24. The end of the piston 26 includes a presser member or fingers 27 which extend over the bundle end 22 to compress the bundle 11 for the lowering action described herein. Compression is against carrier member 20.

To position the cylinder assembly into the clamping position, another cylinder assembly is utilized, and it consists of a cylinder 28 and a piston 29 which is shown pinned to the cylinder 24 by a pin 31. The cylinder assembly is also shown to be pivotally pinned to the carrier through the pin 32 and the carrier extension or portion 33 which is understood to be a part of the carrier 18.

Figure 2:
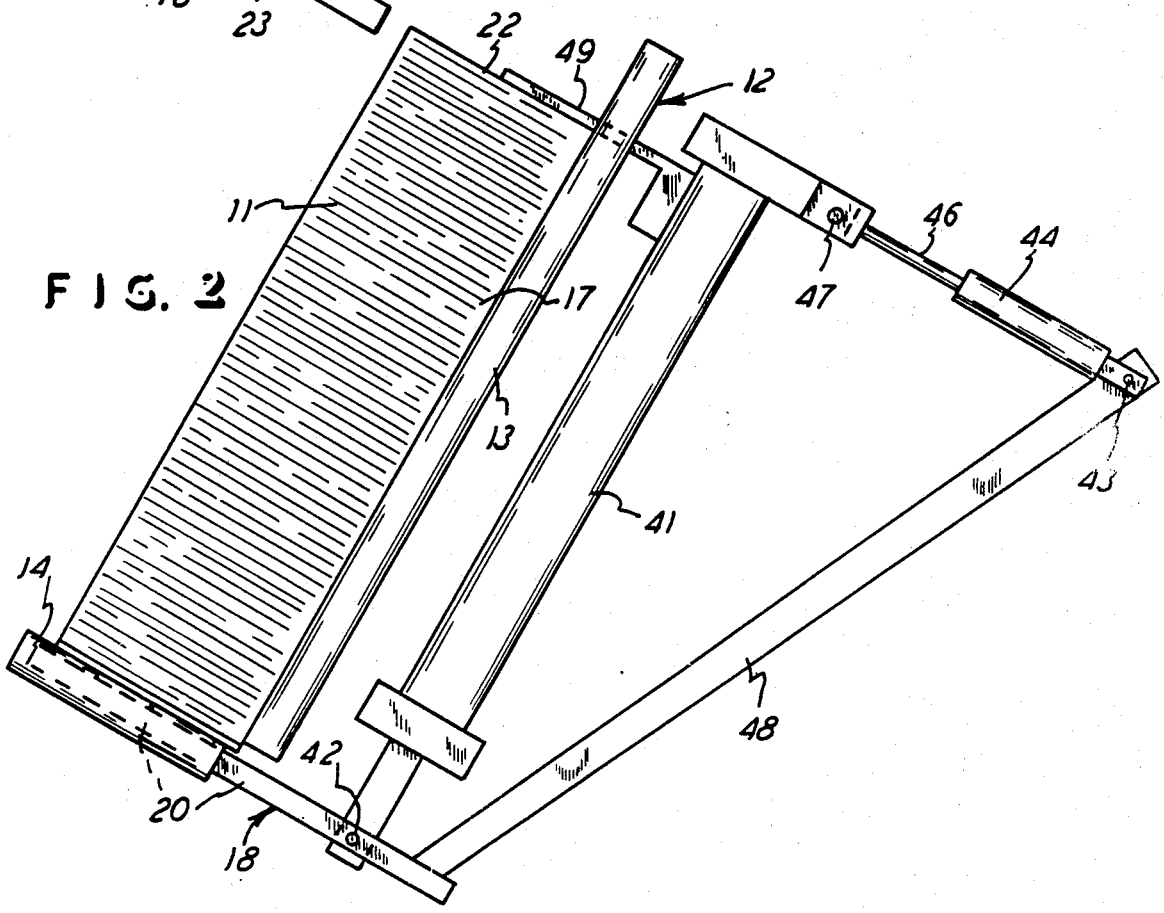
FIG. 2 is a side elevational view of another embodiment of this invention applied to a stacker shown in a portion thereof.

As shown in FIGS. 1 and 2, the stack is shown to be in a slightly reclining position. Since the rollers 13 are also shown in the reclining position, which is also the position shown in the referenced patents, and thus the stack has its side or sheet edges 17 in upwardly supportive or sliding relationship relative to the rollers 13. Therefore, when the stack 11 is fully formed, then the cylinder 28 is energized to pivot the cylinder 24 into the position shown in FIG. 1, and the cylinder 24 is then retracted for drawing the fingers 27 downwardly on the bundle top 22 for clamping the bundle 11. Of course when the bundle 11 is to be released, then the cylinder 24 projects the piston rod 26 and the cylinder 28 also then contracts for withdrawing its piston rod 29 and moving the fingers 27 out of the stacking area which is rightwardly of the row of rollers 13.

To produce the synchronization of the two cylinder assemblies disclosed, a pneumatic system could be employed, and it therefore shows a pneumatic line 34 and a pneumatic line 36, respectively leading to the cylinder 24 and 28, and it shows a pneumatic supply line 37. A pneumatic control 38 is connected to the several lines mentioned, and a control button 39 can be employed. Thus, it will be understood that through conventional equipment, depressing the control button 39 will cause the sequencing of the cylinder assemblies, such as to first pressurize the line 36 and position the cylinder 24 in the FIG. 1 position, and subsequently the line 34 is pressurized to retract the piston rod 26 and apply the finger 27 to the top 22 of the bundle 11. Of course the opposite sequence is employed when the bundle 11 is to be released, but there is conventional equipment employed for sequencing the two cylinder assemblies for both the clamping and unclamping action mentioned.

FIG. 2 shows that generally the same arrangement as described in connection with FIG. 1, except that in FIG. 2 a cylinder assembly 41 is employed and is somewhat different from the assembly of the cylinder 24 and its piston rod 26. However, the assembly 41 is also mounted on the carrier 18, and it is by means of a pivot pin 42, and it is also by means of a pivot pin 43 and the connection of a cylinder 44 and piston rod 46 and a pivot pin 47 which connects to the cylinder assembly 41. The entire unit is further mounted on the carrier 18 by means of a strut or member 48 which is part of the carrier 18 and which carries the pin 43.

Again, an upper presser member or a finger 49 is attached to the cylinder assembly 41 for extending over, and thus bearing downwardly, on the bundle top 22 for clamping the bundle downwardly and against the carrier member 18. Again, the bundle 11 is then lowered when in that clamped position, and the entire assembly 41 lowers with the lowering carrier 18, to thus avoid the bending or distortion of the sheet ends or edges 17 in the lowering action while the sheets slide along the stacker support member 13.

In this apparatus and method, the stack or bundle 11 is fully formed in its upper or first position, and it is then clamped by the clamping mechanism described, and the bundle 11 is then lowered, while still being clamped, to its lowered or second position. In all instances, the clamp function and apparatus are integral with the movement and equipment of the conventional carrier which lowers the bundle to that second position. Also, in both arrangements, there is the displacement means, including the cylinders 28 and 44, which move the clamp assembly portions 27 and 49 into position for ultimate clamping of the bundle 11. The cylinders 24 and 41 are further referred to as force applicators since they cause the pressers 27 and 49 to bear downwardly on the upper end 22 of the bundle 11 and thereby clamp the bundle to the carrier 18. The pressers 27 and 49 are shown to extend beyond the support member 13, and are also shown to be in pressing contact with the bundle upper end 22, and thus extend across to both sides of the inclined plane of the sheet edges 17 and thereby bear downwardly on the edges 17, all as viewed in FIGS. 1 and 2.

It is claimed:

1. In a sheet stacker wherein sheets are formed into a stack relationship having a stack top and with the sheet edges disposed along an inclined plane and on and in contact with an inclined support extending along said inclined plane and with the sheets stacked on a stack carrier which engages one end of the stack while the stack is being formed and which moves the stack downwardly along the inclined direction of said inclined support, the improvement comprising a clamp assembly attached to said carrier for movement both relative to and with said carrier, said clamp assembly including a movable portion extending across and being movable along said inclined plane for engaging said top of said stack and being in contact with said stack top at the intersection of said top and the inclined plane of said edges, displacement means for moving said assembly relative to said carrier to thereby position said movable portion for engaging said stack opposite end, and said clamp assembly including a force applicator for pressing said movable portion against said stack opposite end and thereby clamp said stack relative to said carrier for the movement of said stack downwardly along said inclined support and thereby prevent said sheet edges from turning upward.

2. The sheet stacker as claimed in claim 1, wherein said force applicator is a fluid cylinder assembly for the clamping of said stack.

3. The sheet stacker as claimed in claim 1, wherein said clamp assembly is pivotally attached at a location on said carrier, and said movable portion is a presser located on said assembly spaced from the location of the pivotal attachment.

4. The sheet stacker as claimed in claim 3, wherein said displacement means is a fluid cylinder assembly pivotally mounted on said carrier and connected to said clamp assembly.

5. The sheet stacker as claimed in claim 1, wherein said displacement means and said force applicator are both fluid cylinder assemblies for inducing movement.

6. The sheet stacker as claimed in claim 5, wherein said fluid cylinder assemblies are both pivotally mounted on said carrier and include a piston, and said piston of said force applicator fluid assembly having said movable portion attached thereto.

7. The sheet stacker as claimed in claim 5, including a control connected to both of said cylinder assemblies for sequential operation of said assemblies.

8. A method of moving a stack of sheets which were stacked onto a carrier in an inclined position while being formed into a stack having a stack top and with said sheets having edges disposed along an inclined plane and on an inclined support and with one end of said stack against said carrier for downward movement along said support to a position of stack removal, characterized in clamping said stack relative to said carrier by applying pressing apparatus onto said stack top and extending across said inclined plane and in contact with said stack top at the intersection of said stack top with said inclined plane, said pressing apparatus being attached to said carrier for movement relative thereto and therewith, and lowering said carrier and said pressing apparatus downwardly in pressing relation on said edges. along said inclined plane while said stack is being clamped, and thereby prevent said sheet edges from curling upward.

9. The method of moving a stack of sheets, as claimed in claim 8, including sequencing the clamping and moving of said stack to initially apply said pressing apparatus and then move said stack downwardly, and to subsequently initially release said pressing apparatus at the downward location.

* * * * *